US008371456B2

(12) United States Patent
Scadden et al.

(10) Patent No.: US 8,371,456 B2
(45) Date of Patent: Feb. 12, 2013

(54) STRUCTURALLY RIBBED SUPPORT COMPONENT FOR MILLWORK DRYING OPERATIONS

(76) Inventors: Curtis J. Scadden, Waunakee, WI (US); Edward A. Raleigh, Lodi, WI (US)

( * ) Notice: Subject to any disclaimer, the term of this patent is extended or adjusted under 35 U.S.C. 154(b) by 82 days.

(21) Appl. No.: 12/902,029

(22) Filed: Oct. 11, 2010

(65) Prior Publication Data

US 2011/0100938 A1 May 5, 2011

Related U.S. Application Data

(60) Provisional application No. 61/258,121, filed on Nov. 4, 2009.

(51) Int. Cl.
*A47F 7/00* (2006.01)

(52) U.S. Cl. ..... 211/59.4

(58) Field of Classification Search ..... 211/59.4, 211/27, 28, 45, 49.1, 60.1, 70.4, 189, 194, 211/182, 183; 34/94, 239, 240, 107, 611; 248/346.01, 346.02, 346.03, 678; 432/258
See application file for complete search history.

(56) References Cited

U.S. PATENT DOCUMENTS

| | | | | | |
|---|---|---|---|---|---|
| 595,895 | A | * | 12/1897 | Solomon | 206/321 |
| 658,913 | A | * | 10/1900 | Hass | 34/94 |
| 2,149,589 | A | * | 3/1939 | Duaei | 211/60.1 |
| 3,130,439 | A | * | 4/1964 | Bovaird | 15/268 |
| 3,739,921 | A | * | 6/1973 | Schmidt | 211/194 |
| 3,834,549 | A | * | 9/1974 | Burg et al. | 211/189 |
| 4,093,076 | A | * | 6/1978 | Newton | 211/74 |
| 4,632,344 | A | * | 12/1986 | Lang et al. | 248/165 |
| 5,085,397 | A | | 2/1992 | Henkel | |
| 5,178,279 | A | * | 1/1993 | Carroll | 206/499 |
| 5,433,322 | A | * | 7/1995 | Williams | 206/443 |
| 5,509,544 | A | | 4/1996 | Osborn | |
| 5,638,809 | A | | 6/1997 | Wienhold | |
| 5,699,925 | A | | 12/1997 | Petruzzi | |
| 5,722,626 | A | * | 3/1998 | Menchetti et al. | 248/346.01 |
| 5,813,137 | A | * | 9/1998 | Townsend | 34/518 |
| 5,931,320 | A | * | 8/1999 | Gajda et al. | 211/193 |
| 6,044,990 | A | * | 4/2000 | Palmeri | 211/189 |
| 6,134,803 | A | * | 10/2000 | Gilchrist et al. | 34/94 |
| 6,338,758 | B1 | | 1/2002 | Curran | |
| RE38,118 | E | * | 5/2003 | Townsend | 34/518 |
| 6,644,966 | B1 | * | 11/2003 | Chiang | 432/253 |
| 6,702,130 | B1 | | 3/2004 | Carlisle | |
| 6,729,089 | B1 | * | 5/2004 | Spragg | 52/296 |
| 7,108,144 | B2 | | 9/2006 | Goodwin | |
| 7,134,560 | B2 | | 11/2006 | Goodwin | |
| 7,278,613 | B2 | * | 10/2007 | Roy | 248/49 |
| 7,926,199 | B2 | * | 4/2011 | Aaron | 34/239 |
| 8,133,049 | B1 | * | 3/2012 | Sullivan et al. | 432/258 |
| 2001/0006163 | A1 | * | 7/2001 | Scudeller | 211/182 |
| 2003/0089829 | A1 | * | 5/2003 | Brandzel et al. | 248/68.1 |
| 2004/0222179 | A1 | | 11/2004 | Garcia | |
| 2005/0072354 | A1 | | 4/2005 | Goodwin | |
| 2007/0131635 | A1 | * | 6/2007 | Shieh | 211/204 |

* cited by examiner

*Primary Examiner* — Darnell Jayne
*Assistant Examiner* — Stanton L Krycinski
(74) *Attorney, Agent, or Firm* — Absolute Technology Law Group, LLC

(57) ABSTRACT

The present invention is a modular stacking system for continuous stack drying of millwork that is easily transported and takes up a minimal amount of floor space when assembled. The modular stacking system is comprised of modular stabilizing stackable blocks and lightweight cross members which allow the user to create multiple stacking layers. The design of the stackable blocks ensures that the stacking system remains stable even with a large number of layers.

8 Claims, 12 Drawing Sheets

STRUCTURALLY RIBBED SUPPORT COMPONENT FOR MILLWORK DRYING OPERATIONS

CROSS-REFERENCE TO RELATED APPLICATIONS

This application claims priority to U.S. Provisional Application No. 61/258,121 filed on Nov. 4, 2009.

FIELD OF INVENTION

The present invention relates to the field of support racks and more particularly to modular stacking systems.

GLOSSARY

Figure 1:
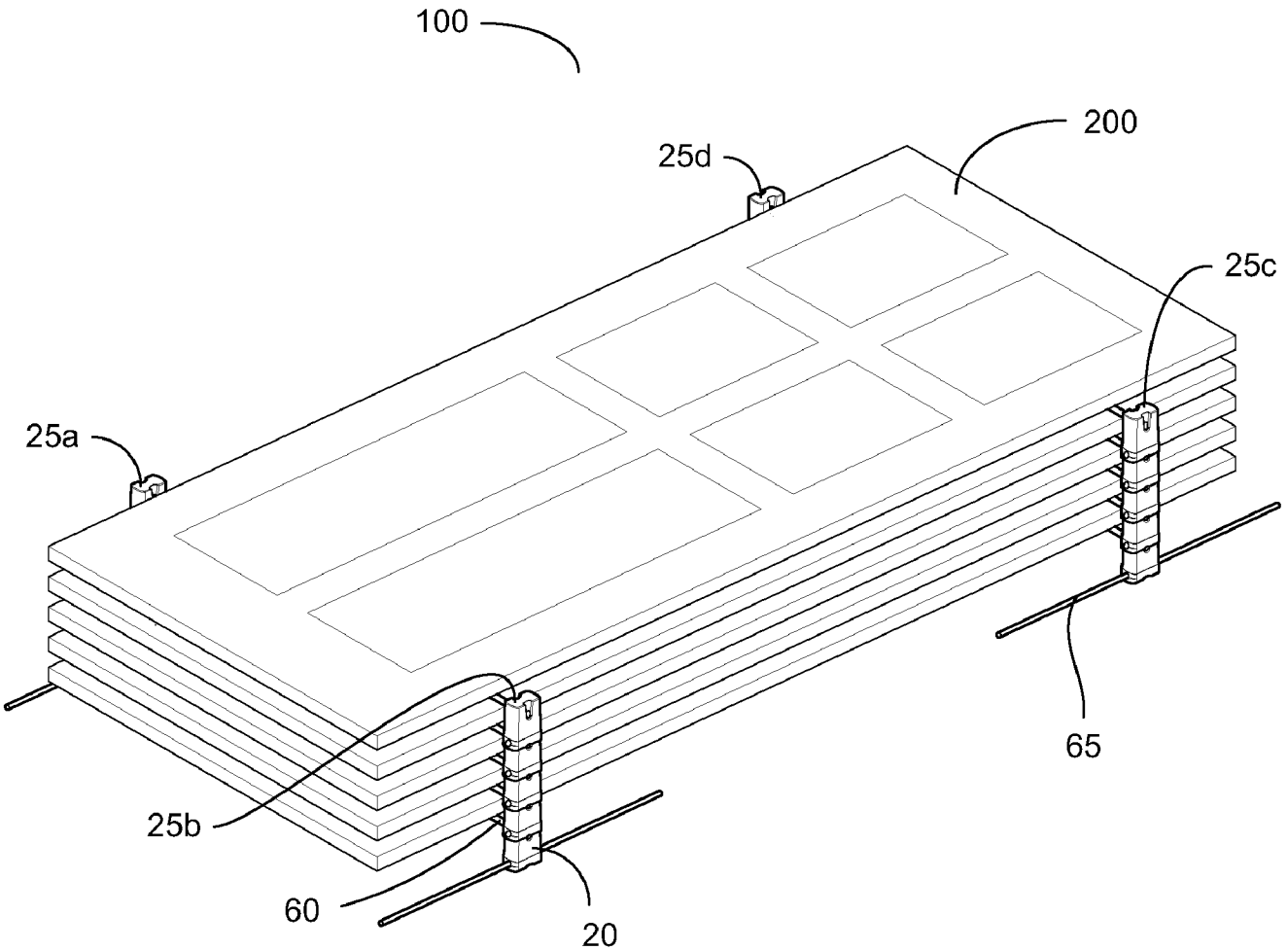
FIG. 1 illustrates a perspective view of an exemplary embodiment of an assembled modular stacking system with five stacking layers in use.

As used herein, the term "continuous stack drying" refers to a task in which a user assembles a plurality of cross members, places an object to be dried onto the cross members, and repeats the process by assembling additional cross members above the object to be dried during the drying/processing operation. A continuous stack drying operation does not require the user to place the object which must be dried in a horizontal space between pre-assembled, stacked cross members.

As used herein, the term "cross member" refers to a component secured horizontally between two stackable blocks on which millwork rests.

As used herein, the term "flange" refers to a rim, band, collar, ring or other structural configuration molded or formed to give additional strength or support or to provide an area to engage other components.

As used herein, the term "friction rib" refers to a protruding or contoured component shaped to provide friction against another component.

As used herein, the term "horizontal stabilizing member" refers to a component placed through a bottom stackable block that rests on the ground and extends parallel to the floor, and which provides additional support to a modular stacking system.

As used herein, the term "knit line" refers to the point where two or more flow fronts join during the molding process, typically after flowing around holes or other obstructions, resulting in a weak area.

As used herein, the term "millwork" refers to woodwork, trim, other construction materials known in the art used to decorate or border openings or wall surfaces, such as casings, moldings, baseboards, cornices, and window frames, or any other object requiring painting, staining, finishing, chemical treatment, or cleaning, and subsequent air drying. Millwork includes items such as canvasses, pottery, manufactured items, and may be made of wood, metal, plastic, fabric, canvas, or any other material that requires drying.

As used herein, the term "self-stabilizing" means not requiring additional support components.

As used herein, the term "stabilizing strut" refers to a component that extends between a horizontal stabilizing member and a cross member to provide additional support to a modular stacking system.

As used herein, the term "stop lip" refers to the component of a stackable block that prevents a cross member from passing completely through the stackable block.

Background

Residential and commercial construction projects typically involve finishing and installing millwork. Millwork, such as trim and doors, is typically stained, varnished or painted before it is installed, which is commonly done at the building site. Before the millwork can be installed it must be allowed to dry. The time it takes for the millwork to air dry ranges from an hour to four hours or more depending on the material and the finishing; however, drying overnight is usually recommended. It is also desirable to dry indoors to protect the millwork and finishing from dust and debris.

For drying, millwork may be leaned against a wall or placed on a set of sawhorses; however, both methods of drying are problematic. Leaning millwork, such as trim, against a wall allows a large amount to be dried at once; however, the trim is not secure and may fall over preventing the trim from drying or requiring that that one or more pieces be refinished or replaced. This method of drying also prevents other phases of the construction project from being completed.

Sawhorses on the other hand, require a large amount of floor space when usually only a limited amount of space is available. In addition, sawhorses allow only one layer of millwork to be dried at a time; therefore, many sets of sawhorses are usually required to dry the amount needed to be dried. Sawhorses also vary in size and weight and take up a lot of space while in use and during transportation and storage. For example, each sawhorse may weigh approximately five pounds. In addition, depending on the size, sawhorses may be difficult to transport and/or require the use of a truck or van.

Examples of rack systems are known in the art; however, these rack systems are not desirable because they contain one or more large pieces that are difficult to transport and/or require extensive assembly. In addition, millwork can be heavy and some of these rack systems are not capable of accommodating and supporting multiple layers of heavy millwork. Rack systems that do accommodate multiple levels usually require that the individual pieces of millwork be horizontally slid into narrow slots, which requires precision and can damage the wet finish.

It is desirable to have a portable and modular stacking system that is stable and easily transportable to replace sawhorses.

It is further desirable to have a portable and modular stacking system that is lightweight while being able to support heavy materials.

It is further desirable to have a portable and modular stacking system that allows the user to add stacking layers as needed.

It is further desirable to have a portable and modular system that can accommodate a wide range of sizes of materials.

It is further desirable to have a portable and modular system which can be adapted to fit the needs of a specific job.

It is further desirable to have a portable and modular system that minimizes the amount of dust/debris free space needed for drying finished woodwork.

Summary Of The Invention

The present invention is a modular stacking system for continuous stack drying of millwork that is easily transported and takes up a minimal amount of floor space when assembled. The modular stacking system is comprised of modular stabilizing stackable blocks and lightweight cross members which allow the user to create multiple stacking layers. The stackable blocks are comprised of a housing having a flattened outer surface, an inner surface, and contoured sides having a flange. The housing further includes apertures for inserting a cross member and a horizontal stabilizing member. A plurality of stacking ribs and structural ribs are located in the interior of the housing.

The first stacking layer is created by inserting two or more cross members between stackable blocks and placing the stackable blocks so that the cross members are parallel to each other with the desired amount of spacing in between the cross members. One or more pieces of millwork may then be arranged over the cross members.

To create additional stacking layers, the process is repeated with the second set of stackable blocks being stacked directly on top of those of the first layer. The user determines the number of stacking layers needed. The design of the stackable blocks ensures that the stacking system remains stable even with a large number of stacking layers.

For additional support, horizontal stabilizing members may be inserted through apertures in the stackable blocks of the first stacking layer. The horizontal stabilizing members rest on the ground, extending parallel to the floor. Stabilizing struts may be used to provide additional support when 7 or more stacking layers are assembled.

DETAILED DESCRIPTION OF INVENTION

For the purpose of promoting an understanding of the present invention, references are made in the text to exemplary embodiments of a modular stacking system for drying millwork, only some of which are described herein. It should be understood that no limitations on the scope of the invention are intended by describing these exemplary embodiments. One of ordinary skill in the art will readily appreciate that alternate but functionally equivalent components, materials, and dimensions may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates a perspective view of an exemplary embodiment of modular stacking system 100 with five stacking layers in use. In the embodiment shown, modular stacking system 100 is comprised of four stacking block columns 25*a*, 25*b*, 25*c*, 25*d*, each of which contains five stackable blocks 20. Between each set of stackable blocks 20 in stacking block columns 25*a*, 25*b* and each set of stackable blocks 20 in stacking block columns 25*c*, 25*d* is cross member 60. When stacked, stackable blocks 20 are self-stabilizing and do not require additional vertical support components.

Each stacking block column further includes horizontal stabilizing members 65. In the embodiment shown, one horizontal stabilizing member 65 is placed through an aperture in the first stackable block 20 of each stacking block column 25*a*, 25*b*, 25*c*, 25*d*. Horizontal stabilizing members 65 rest on the ground and extend parallel to the floor providing additional support to modular stacking system 100.

In the embodiment shown, cross members 60 and horizontal stabilizing members 65 are comprised of the same material and have the same dimensions. In other embodiments, horizontal stabilizing members are not used or may be comprised of a different material and/or have different dimensions than the cross members.

In the embodiment shown, two cross members 60 are used resulting in four columns 25*a*, 25*b*, 25*c*, 25*d*. In other embodiments, more cross members and columns may be used to provide additional support (e.g., for longer materials).

Also visible is millwork 200 which rests on cross members 60. In the embodiment shown, millwork 200 is a plurality of doors.

Modular stacking system 100 allows for continuous stack drying. The user assembles stacking layers as needed, permitting the user to simply set pieces of millwork on top of cross members 60, rather than having to slide the pieces between preassembled stacking layers or already placed pieces. Placing the millwork directly on top of cross members 60 saves time and protects the upper surface of the piece from damage.

Figure 2:
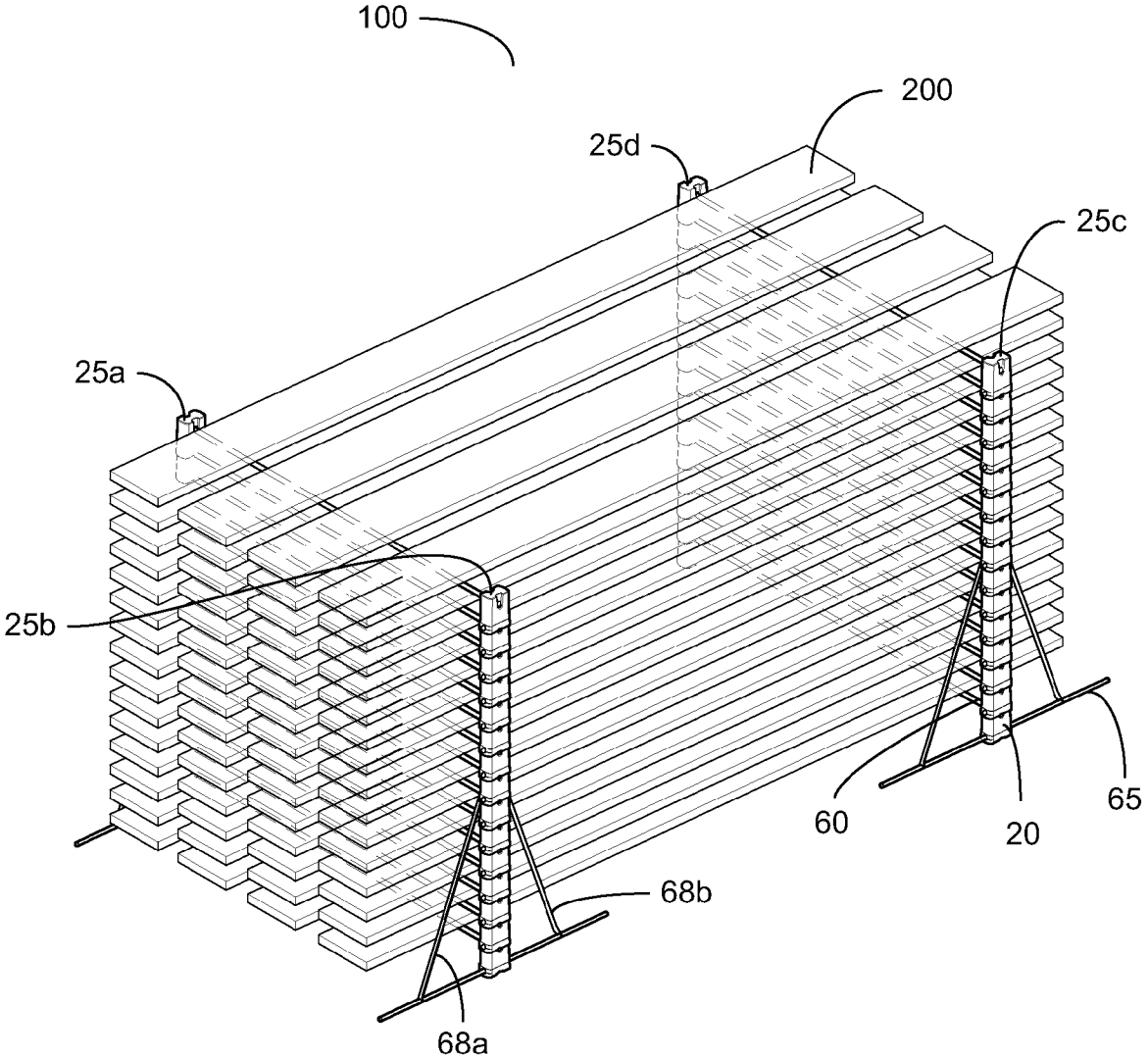
FIG. 2 illustrates a perspective view of an exemplary embodiment of an assembled modular stacking system with fifteen stacking layers in use.

FIG. 2 illustrates a perspective view of an exemplary embodiment of modular stacking system 100 with fifteen stacking layers in use. In the embodiment shown, modular stacking system 100 is comprised of four stackable block columns 25*a*, 25*b*, 25*c*, 25*d*, each of which contains 15 stackable blocks 20. Between each set of stackable blocks 20 in stackable block columns 25*a*, 25*b* and each set of stackable blocks 20 in stackable block columns 25*c*, 25*d* is cross member 60 (shown in phantom).

Each stackable block column further includes horizontal stabilizing members 65. In the embodiment shown, one horizontal stabilizing member 65 is placed through an aperture in the first stackable block 20 of each stackable block column 25*a*, 25*b*, 25*c*, 25*d*.

In the embodiment shown, each stackable block column 25*a*, 25*b*, 25*c*, 25*d* of modular stacking system 100 further includes stabilizing struts 68*a*, 68*b* which are placed on each side of each stackable block column 25*a*, 25*b*, 25*c*, 25*d*. The top of stabilizing struts 68*a*, 68*b* is U-shaped and hooks onto the top of cross member 60. The bottom of stabilizing struts 68*a*, 68*b* is forked and has two prongs which rest on each side of horizontal stabilizing member 65. In the embodiment shown, the top of stabilizing struts 68*a*, 68*b* are hooked on the cross member that runs between the seventh stackable blocks 20 in each stackable block columns 25*a*, 25*b* and stackable block columns 25*c*, 25*d*.

Stabilizing struts 68*a*, 68*b* provide addition support to modular stacking system 100. In an exemplary embodiment, stabilizing struts 68*a*, 68*b* are used when modular stacking system 100 contains 7 or more stacking layers.

In the embodiment shown, millwork 200 is a plurality of trim pieces.

In an exemplary embodiment, the components of modular stacking system 100 are sold in 5 or 10 stacking layer kits. For example, the 5 stacking layer kit would include 20 stackable blocks and 14 cross members and horizontal stabilizing members (e.g., 40 inches long), while a 10 stacking layer kit would include 40 stackable blocks, 24 cross members and horizontal stabilizing members, and 4 stabilizing struts. In other embodiments, modular stacking system 100 is sold in a kit containing components needed to assemble fewer or more layers. In addition, the components needed to create additional layers may be sold separately.

In an exemplary embodiment, modular stacking system 100, when dissembled, may be and stored and transported in a single carry bag (e.g., having a length of 42 inches, a width of 10 inches, and a height of 8 inches).

Figure 3:
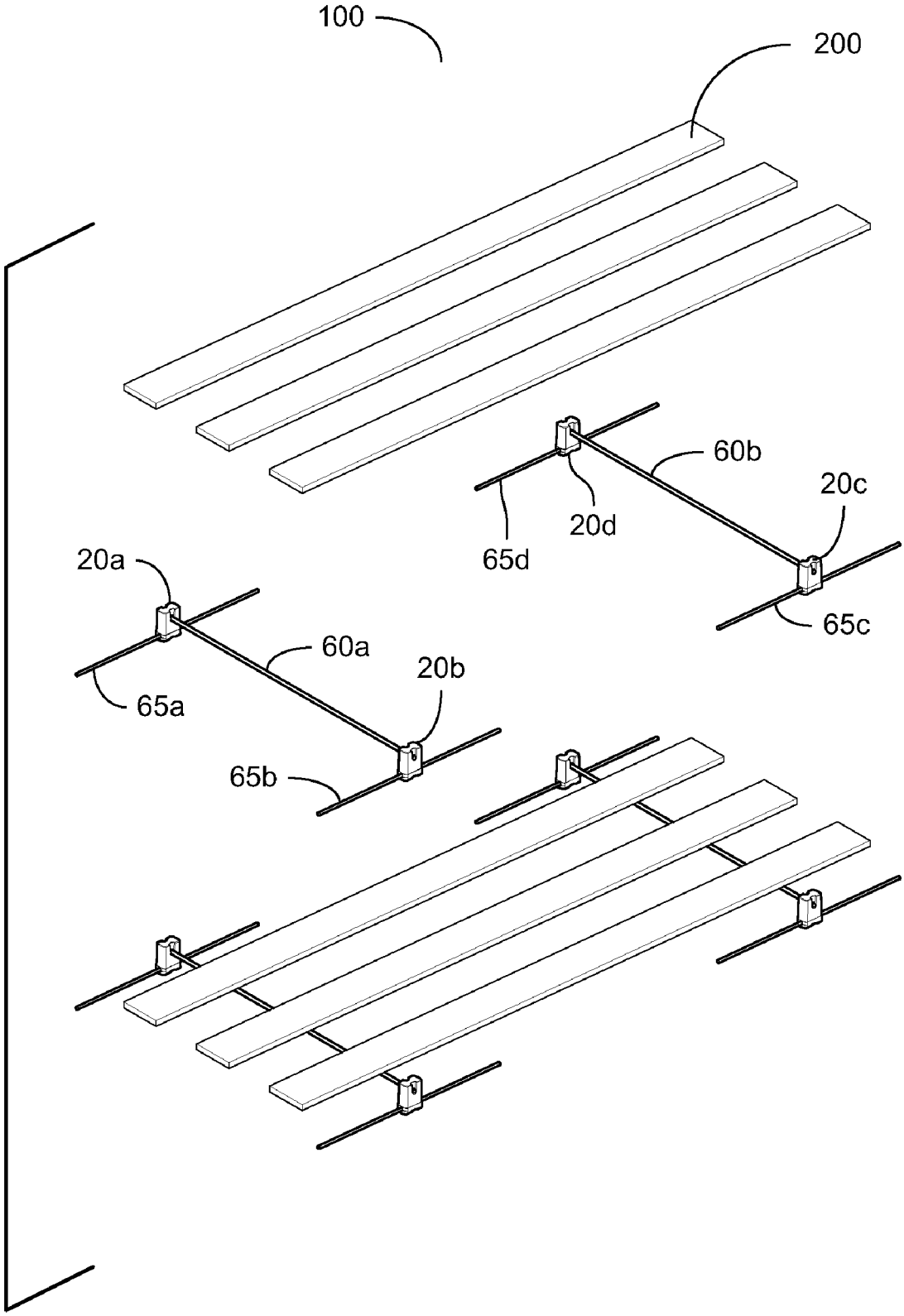
FIG. 3 illustrates an exploded view of an exemplary embodiment of a modular stacking device and millwork.

FIG. 3 illustrates an exploded view of an exemplary embodiment of modular stacking device 100 with millwork 200. To assemble the first stacking layer of modular stacking system 100, stackable blocks 20*a*, 20*b* are assembled into the ends of cross member 60*a* and stackable blocks 20*c*, 20*d* are assembled into the ends of cross member 60*b* creating stacking block columns 25*a*, 25*b*, 25*c*, 25*d* (see FIGS. 1 and 2).

Cross members 60*a*, 60*b* with attached stackable blocks are placed on a flat surface so that cross members 60*a*, 60*b* are parallel to each other creating the first stacking level of modular stacking system 100. The distance between cross members 60*a*, 60*b* may vary depending on the length of the material to be supported.

In the embodiment shown, one horizontal stabilizing members 65*a*, 65*b*, 65*c*, 65*d* is placed through an aperture in each stackable block which makes up the first stacking layer, i.e., stackable blocks 20*a*, 20*b*, 20*c*, 20*d*.

When the first stacking layer is assembled, millwork 200 is laid across the top of horizontal cross members 60*a*, 60*b* as shown. After millwork 200 is placed, a second stacking layer may be added by placing a second set of cross members and attached stackable blocks on top of cross members 60*a*, 60*b* and stackable blocks 20*a*, 20*b*, 20*c*, 20*d*. Millwork is then placed on the second stacking layer, followed by the addition of additional sets of cross members and stackable blocks as needed.

In the embodiment shown, stackable blocks 20 weigh less than ½ lb, with a length of 4 inches, a width of 2¼ inches and a height of 4½ inches and are molded so that they interlock when stacked. In other embodiments, stackable blocks 20 have a length and width of 2 to 6 inches and a height of 3 to 6 inches high.

In the embodiment shown, cross members 60 and horizontal stabilizing members 65 are round and hollow with a diameter of ⅝ inch and are made of steel. In other embodiments, cross members 60 and horizontal stabilizing members 65 may be solid, tubular, square, rectangular, flattened, telescoping or any other shape and configuration and may be made of another material, such as aluminum or plastic. In the embodiment shown, cross members 60 and horizontal stabilizing members 65 have a diameter of ⅝ inch, is hollow and is comprised of steel. In other embodiments, cross members 60 and horizontal stabilizing members 65 have a smaller or larger diameter and is comprised of another material, such as aluminum or plastic.

In the embodiment shown, cross members 60*a*, 60*b* and horizontal stabilizing members 65*a*, 65*b*, 65*c*, 65*d* are comprised of the same material and have the same dimensions. In other embodiments, horizontal stabilizing members are not used or may be comprised of a different material and/or have different dimensions than the cross members.

Figure 4A:
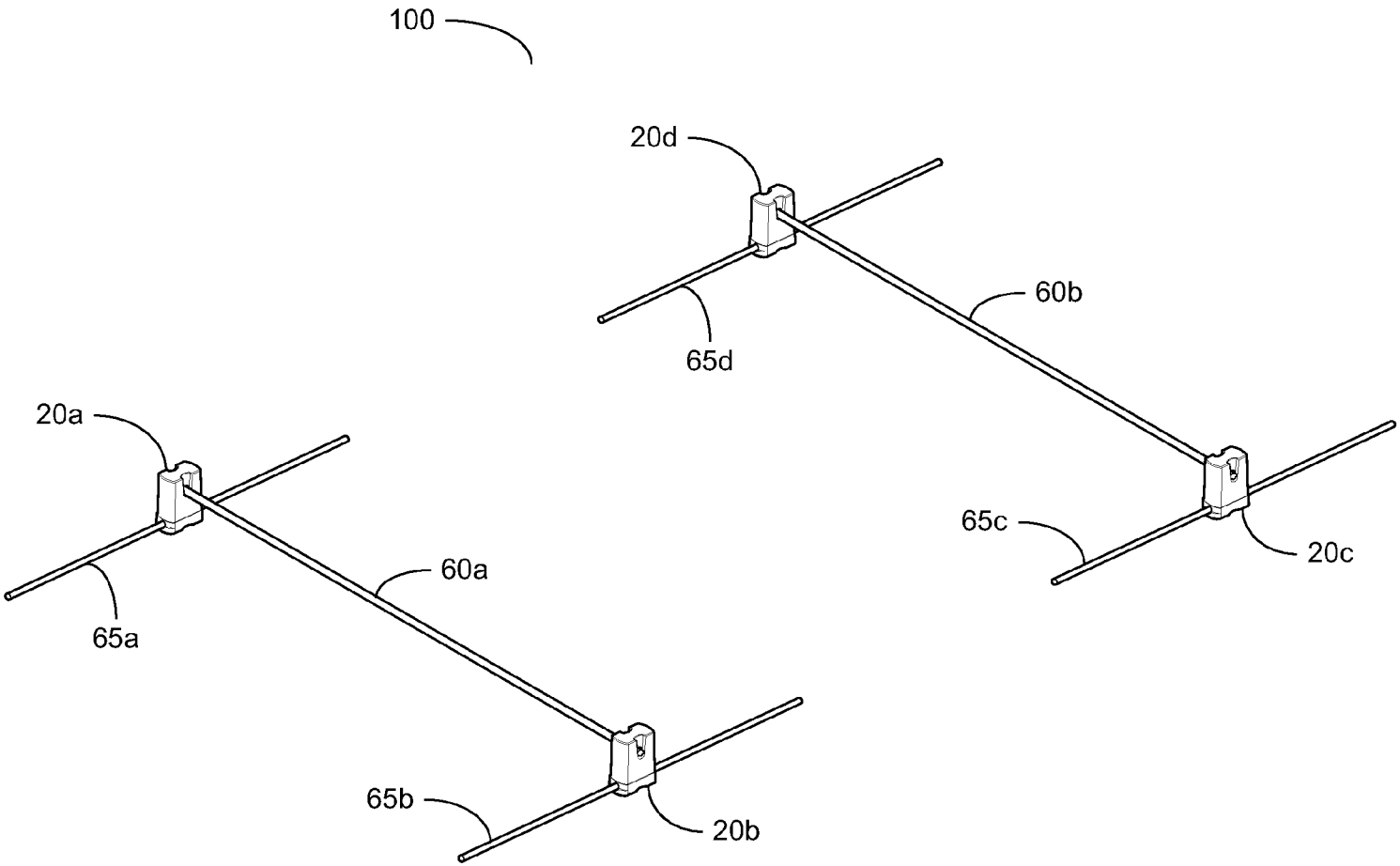
FIG. 4*a* illustrates a perspective view of one exemplary embodiment of an assembled modular stacking system with one stacking layer.

FIG. 4*a* illustrates a perspective view of one exemplary embodiment of modular stacking system 100 with one stacking layer. In the embodiment shown, four horizontal stabilizing members 65*a*, 65*b*, 65*c*, 65*d* are used and each is inserted through a single stackable block 20*a*, 20*b*, 20*c*, 20*d*. Stackable blocks 20*a*, 20*b*, 20*c*, 20*d* and horizontal stabilizing members 65*a*, 65*b*, 65*c*, 65*d* are positioned so that horizontal cross members 60*a*, 60*b* are located a substantial distance apart (i.e., for drying doors or longer pieces of trim).

Figure 4B:
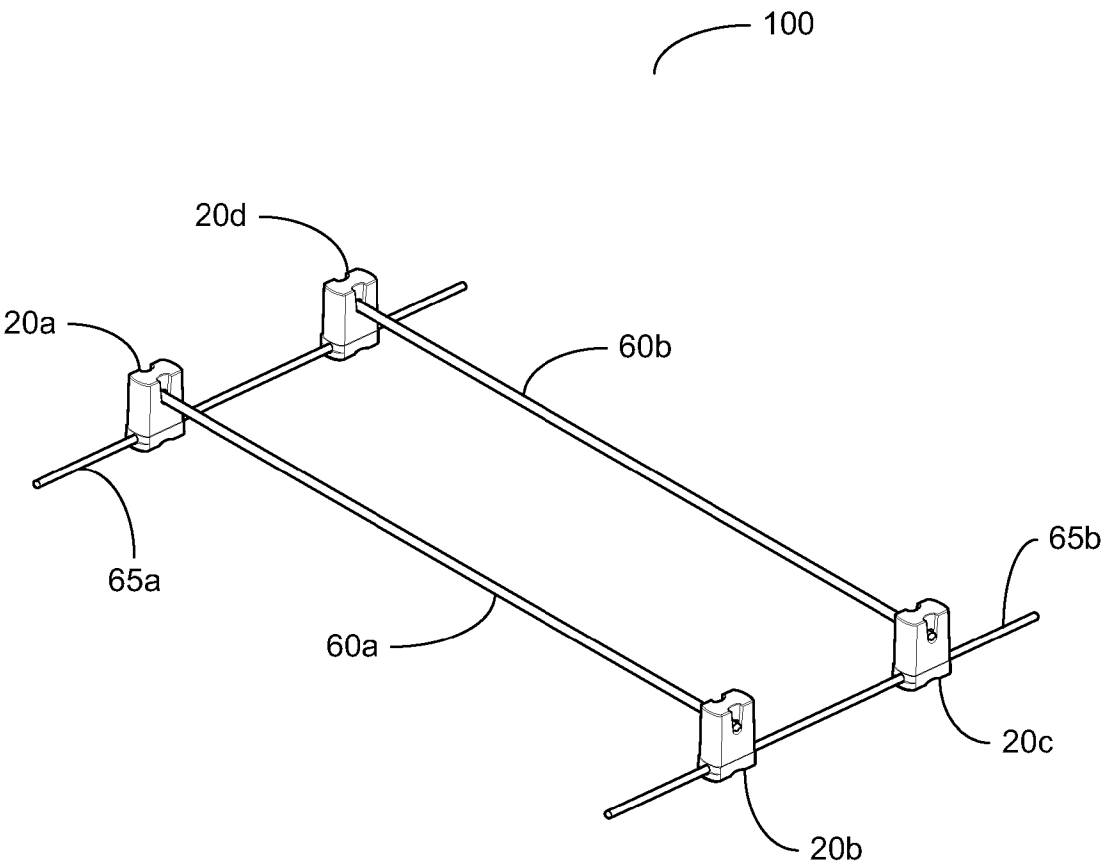
FIG. 4*b* illustrates a perspective view of a second exemplary embodiment of an assembled modular stacking system with one stacking layer.

FIG. 4*b* illustrates a perspective view of a second exemplary embodiment of modular stacking system 100 with one stacking layer. In the embodiment shown, only two horizontal stabilizing members 65*a*, 65*b* are used. Horizontal stabilizing member 65*a* is inserted through stackable blocks 20*a*, 20*b* and horizontal stabilizing member 65*b* is inserted through stackable blocks 20*c*, 20*d* allowing cross members 60*a*, 60*b* to be located closer to one another (i.e., for drying smaller millwork, such as cabinet doors).

Figure 5:
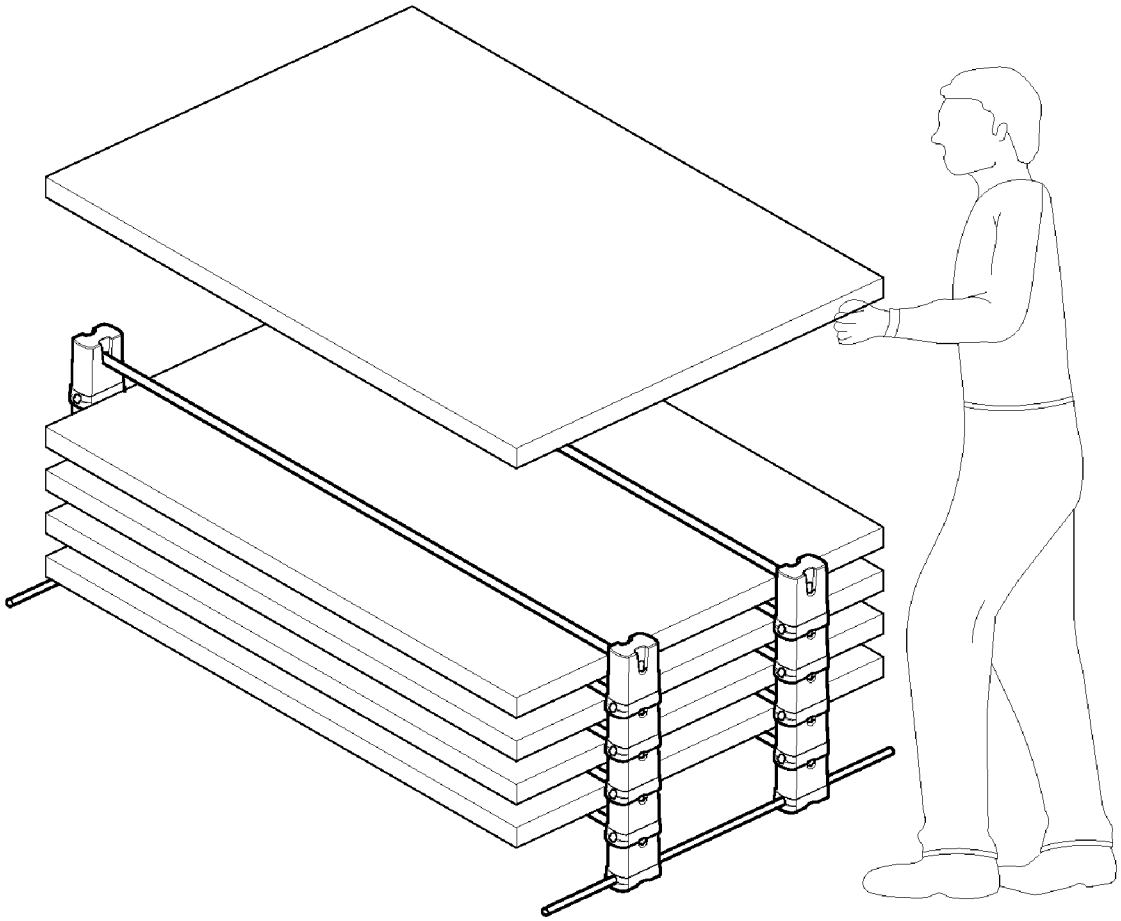
FIG. 5 illustrates a perspective view of an exemplary embodiment of an assembled modular stacking system in use.

FIG. 5 illustrates a perspective view of an exemplary embodiment of modular stacking system 100 in use.

Figure 6A:
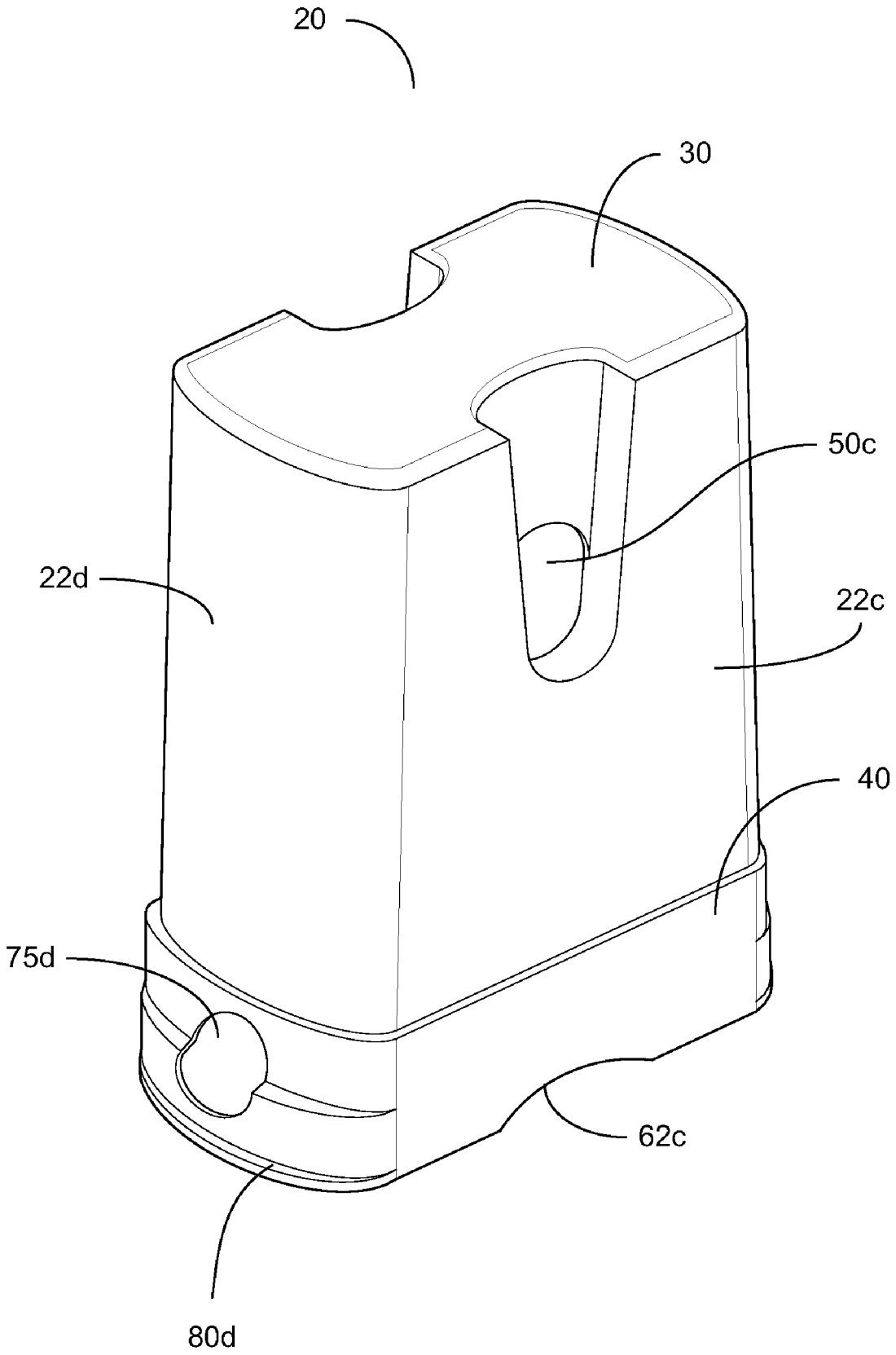
FIG. 6*a* illustrates a perspective view of the back of an exemplary embodiment of a stackable block for a modular stacking system.

FIG. 6*a* illustrates a perspective view of the back of an exemplary embodiment of stackable block 20 for modular stacking system 100. The side of stackable block 20 illustrated in FIG. 6*a* faces inward when modular stacking system 100 is assembled.

Stackable block 20 is comprised of outer surface 30, contoured sides 22*a*, 22*b*, 22*c*, 22*d* (22*a*, 22*b* not visible) and flange 40. Contoured sides 22*a*, 22*c* further include cross member apertures 50*a*, 50*c* (50*a* not visible) and bottom cross member apertures 62*a*, 62*c* (62*a* not visible). Contoured sides 22*b*, 22*d* further include horizontal stabilizing member apertures 75*b*, 75*d* (75*b* not visible) for inserting horizontal stabilizing member 65 (not shown) and base protuberances 80*b*, 80*d* (80*b* not visible) for supporting optional horizontal stabilizing member 65.

In the embodiment shown, stackable block 20 is semi-rectangular with contoured sides 22*a*, 22*b*, 22*c*, 22*d* that are tapered to facilitate removal from the mold during injection molding. In the embodiment shown, contoured sides 22*a*, 22*c* are flat and contoured sides 22*b*, 22*d* are concave.

Horizontal stabilizing member 65 is placed through horizontal stabilizing member apertures 75*b*, 75*d* of stackable block 20 of first stacking layer so that approximately equal length of horizontal stabilizing member 65 sticks out on each side of stackable block 20. Base protuberances 80*b*, 80*d* provide additional reinforcement to stackable block 20 and help avoid fracturing of stackable block 20 at the knit line as well as provide additional structural support to modular stacking system 100.

Cross member apertures 50*a*, 50*c* are adapted to receive cross member 60. Cross member 60 is inserted through cross member aperture 50*c* in contoured side 22*c* and passed through the interior of stackable block 20 and cross member aperture 50*a* in contoured side 22*a*. Stop lip 70 (see FIG. 6*b*) stops cross member 60 preventing cross member 60 from passing completely through stackable block 20.

Bottom cross member apertures 62*a*, 62*c* facilitate stacking and are shaped to accommodate the top edge of the cross member of the previous layer allowing a stackable block to be placed on top of another without contacting the cross member of the previous layer.

In the embodiment shown, stackable block 20 is comprised of a rigid thermoplastic polymer (e.g., polypropylene) and is capable of supporting the weight of multiple stacking layers and millwork. In the embodiment shown, stackable block 20 is injection molded, but in other embodiments may be formed by using another molding or manufacturing process. In various embodiments, stackable block 20 may contain marks which result from the manufacturing process. For example, outer surface 30 of stackable block 20 may have a vestige.

Figure 6B:
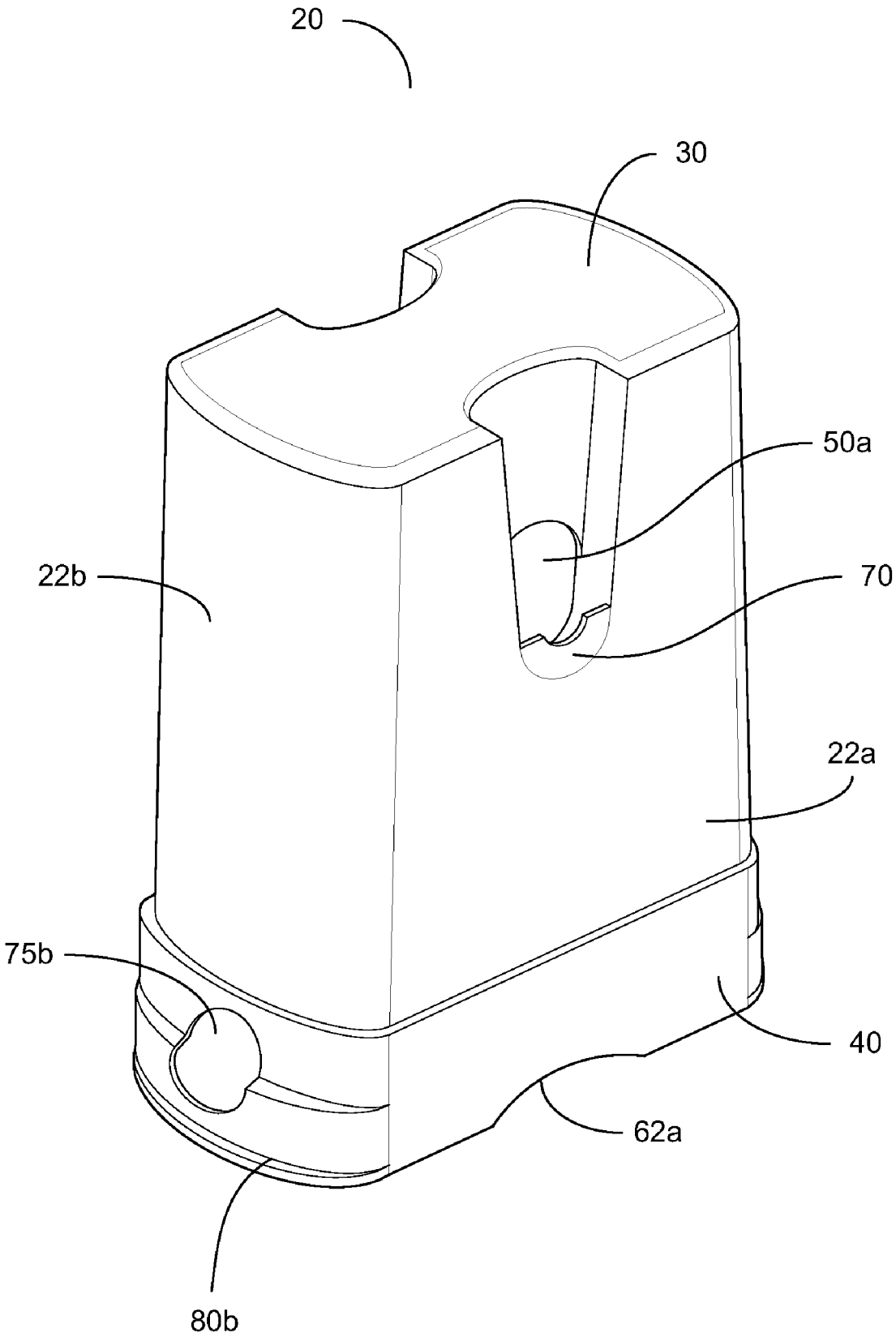
FIG. 6*b* illustrates a perspective view of the front of an exemplary embodiment of a stackable block for a modular stacking system.

FIG. 6*b* illustrates a perspective view of the front of an exemplary embodiment of stackable block 20 for modular stacking system 100. The side of stackable block 20 illustrated in FIG. 6*b* faces outward when modular stacking system 100 is assembled.

Visible are outer surface 30, contoured sides 22*a*, 22*b*, flange 40, cross member aperture 50*a*, stop lip 70, bottom cross member aperture 62*a*, horizontal stabilizing member aperture 75*b*, and base protuberance 80.

Figure 7A:
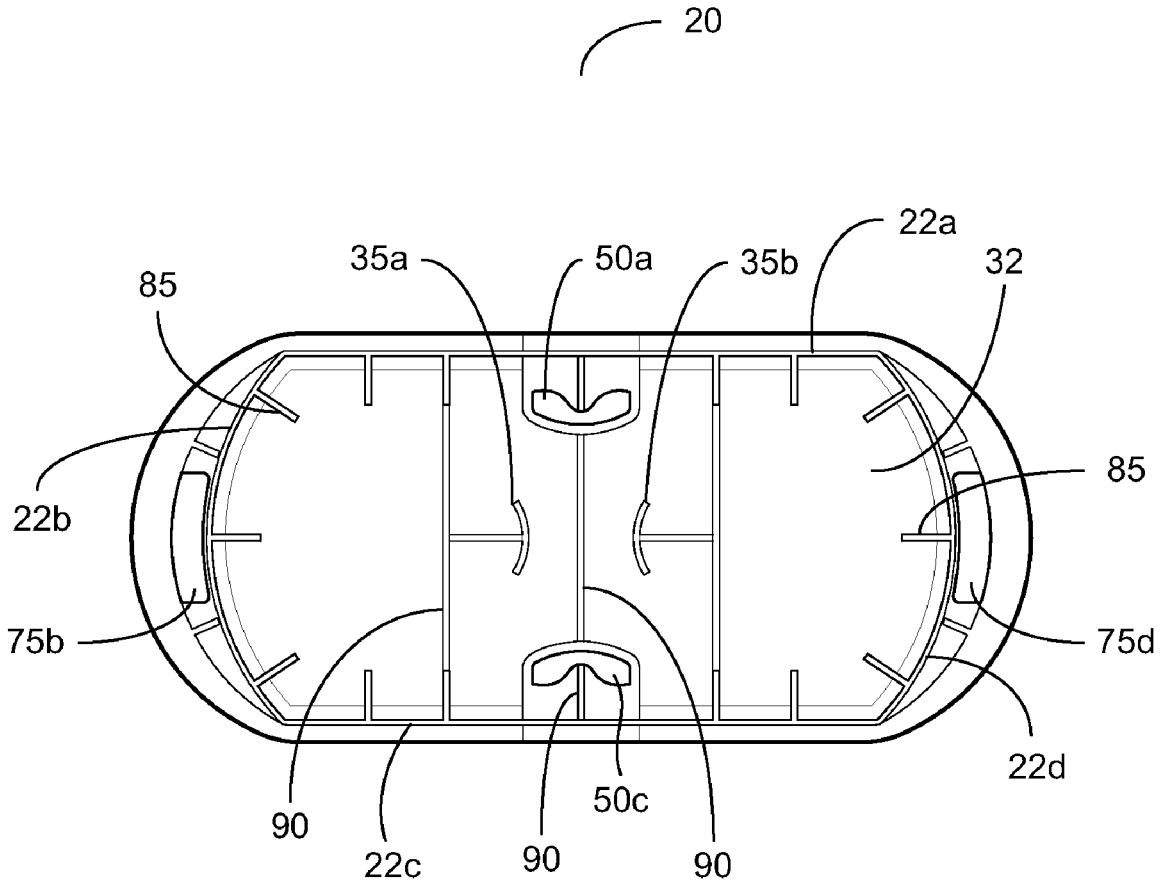
FIG. 7*a* illustrates a bottom view of an exemplary embodiment of a stackable block for a modular stacking system.

FIG. 7*a* illustrates a bottom view of an exemplary embodiment of stackable block 20. The inside of stackable block 20 contains friction ribs 35*a*, 35*b*, stacking ribs 85 which extend from inner surface 32 (underside of outer surface 30) to top of flange 40 (not shown) and structural ribs 90 which provide additional structure support, strengthening stackable block 20.

When second stackable block 20*b* is stacked onto first stackable block 20*a* (see FIG. 9), stacking ribs 85 of second stackable block 20*b* rest on the outer surface 30 of first stackable block 20*a* so that flange 40 of second stackable block 20*b* overlaps the upper portion of first stackable block 20*a*.

Figure 7B:
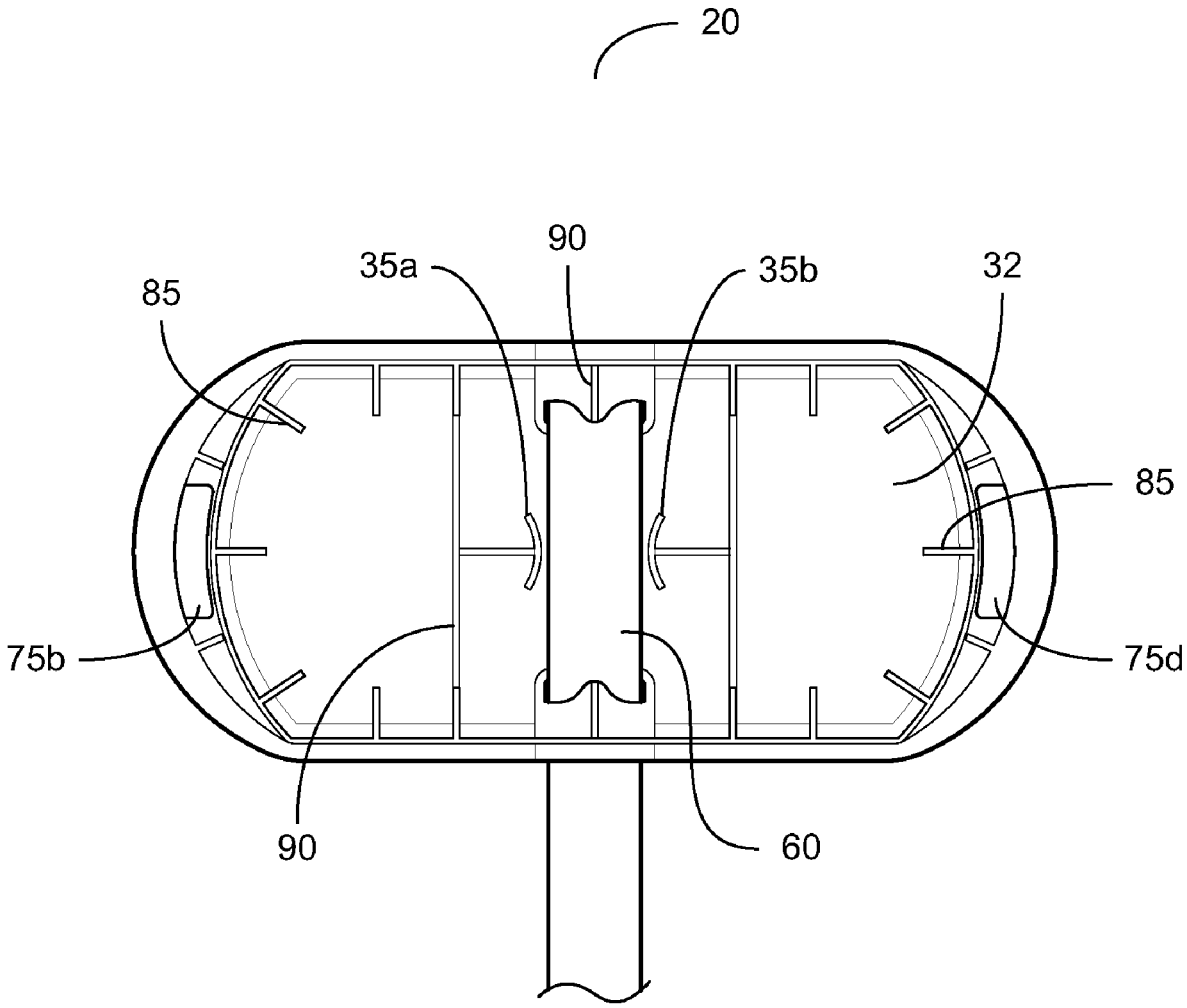
FIG. 7*b* illustrates a bottom view of an exemplary embodiment of a stackable block for a modular stacking system with a cross member.

In the embodiment shown, friction ribs 35*a*, 35*b* are curved so that only a portion of friction ribs 35*a*, 35*b* contacts cross member 60 (see FIG. 7*b*). In other embodiments, there may be more or fewer friction ribs 35*a*, 35*b* and/or friction ribs of varied shapes to provide the desired amount of contact with cross member 60.

In the embodiment shown, stackable block 20 has fourteen stacking ribs 85 which extend out ¼ inch from contoured sides 22*a*, 22*b*, 22*c*, 22*d* and are spaced 0.3 to 0.75 inches apart. In other embodiments, stackable block 20 may have more or fewer stacking ribs 85 which are shorter or longer (e.g., could extend from one side to the other) and/or with varied placement and spacing. In the embodiment shown, structural ribs 90 have various connecting points (e.g., inner surface) and are of various heights and shapes. In other embodiments, there may be more or fewer structural ribs in varied locations.

The design of stackable block 20 allows stackable blocks 20 to support the weight of cross members 60 and millwork 200 so that up to 15 stacking layers may be assembled. In an exemplary embodiment, stackable blocks 20 can support up to approximately 200 lbs on 15 stacking layers and up to approximately 500 lbs on 10 stacking layers.

FIG. 7*b* illustrates a bottom view of an exemplary embodiment of stackable block 20 with cross member 60. When cross member 60 is inserted into stackable block 20, friction ribs 35*a*, 35*b* brush against cross member 60.

Figure 8:
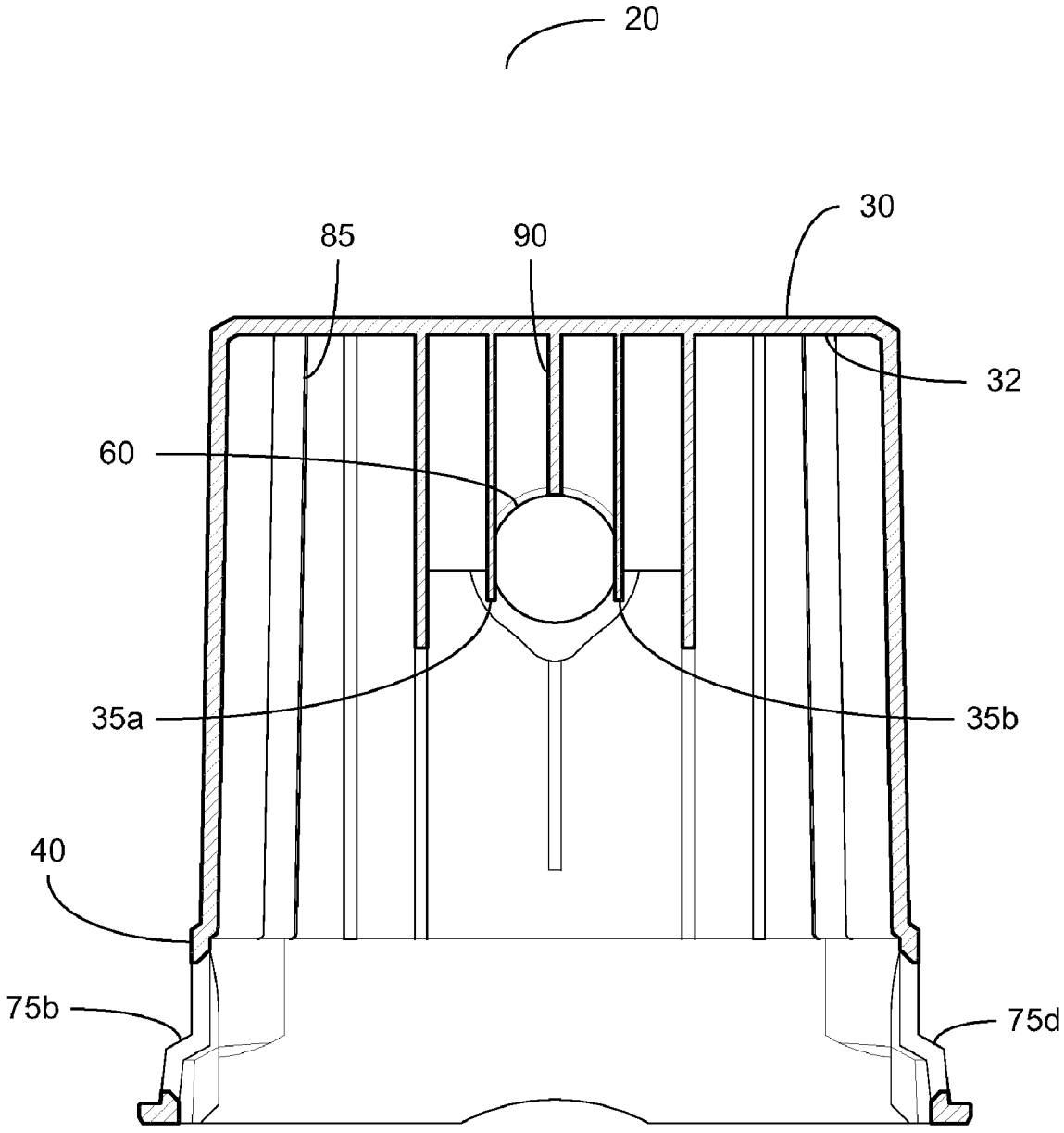
FIG. 8 illustrates a cross-sectional view of an exemplary embodiment of a stackable block for a modular stacking system.

FIG. 8 illustrates a cross-sectional view of an exemplary embodiment of stackable block 20 showing outer surface 30, inner surface 32, friction ribs 35*a*, 35*b*, stacking ribs 85, structural ribs 90, flange 40, horizontal stabilizing member apertures 75*b*, 75*d*, and cross member 60.

Figure 9:
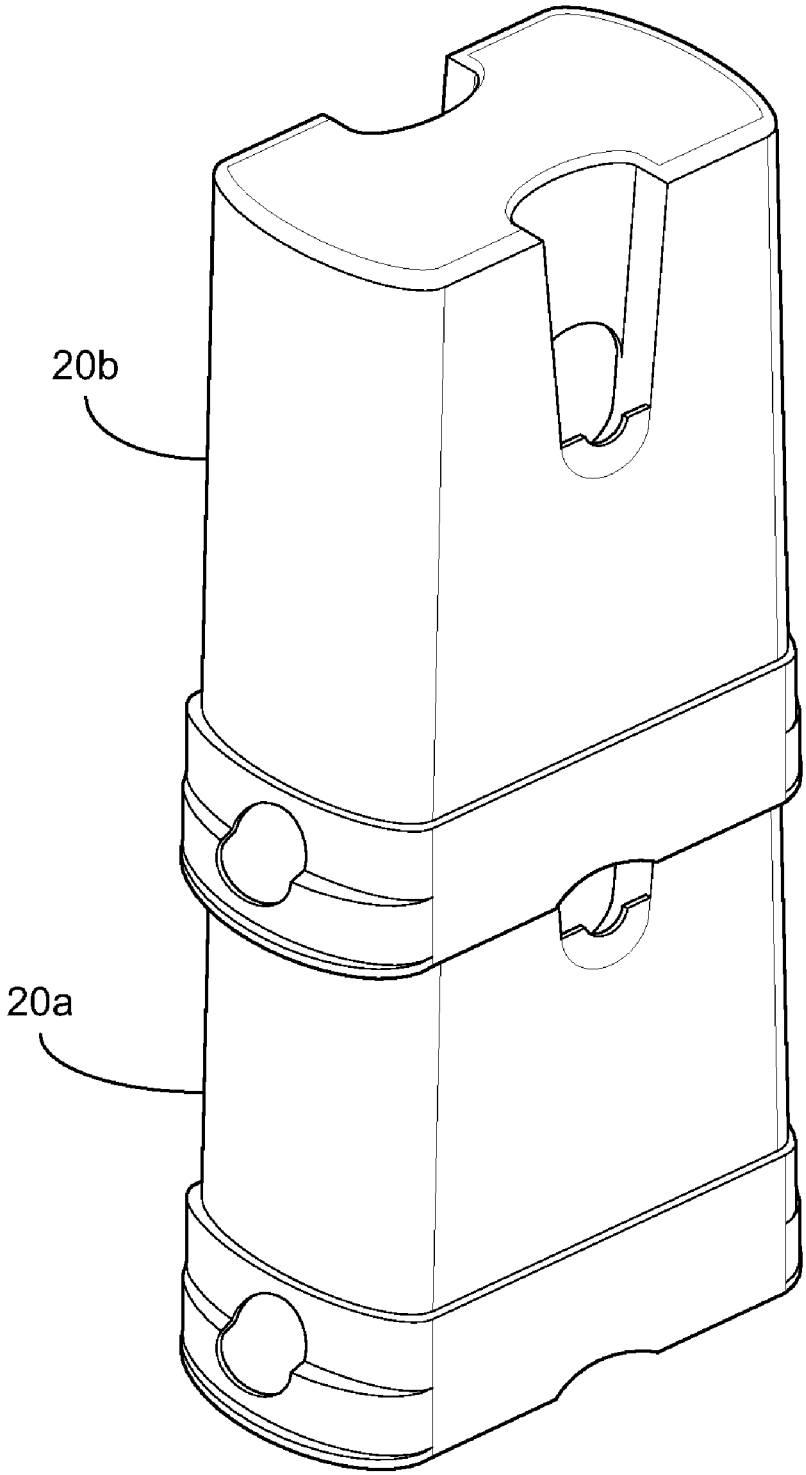
FIG. 9 illustrates a perspective view of the front of two stacked stackable blocks for a modular stacking system.

FIG. 9 illustrates a perspective view of stackable block 20*a* and stackable block 20*b* stacked.

What is claimed is:

1. A stabilizing stackable block system for continuous stack drying comprised of:

a plurality of cross members;

a plurality of horizontal stabilizing members;

a plurality of stabilizing stackable block components, each of said stabilizing stackable block components comprised of a housing having a flattened upper surface, an inner surface, a base opening, a first contoured side, a second contoured side, and two flattened sides, each of said contoured sides having a flange;

wherein each of said flattened sides further include a u-shaped recessed portion disposed on an upper half of said flattened sides, each of said u-shaped recessed portions having a cross member aperture adauted to receive one of said cross members, said apertures being in alignment with each other;

wherein one of said u-shaped recessed portions further includes a stop lip;

a plurality of stacking ribs on the inner surface of each of said plurality of said stabilizing stackable block components adapted to rest on the outer surface of another of said stabilizing stackable block components;

at least two friction ribs on the inner surface of each of said plurality of said stabilizing stackable block components wherein said friction ribs are adapted to physically contact one of said cross members; a plurality of strengthening inner structural ribs on the inner surface of each of said plurality of stabilizing stackable block components;

wherein said first and second contoured sides further include horizontal stabilizing member aperture adapted receive one of said horizontal stabilizing members and a base protuberance;

a plurality of stabilizing struts, each of said stabilizing struts being removably attachable to one of said cross members and one of said horizontal stabilizing members, wherein each of said stabilizing struts has a forked interlocking end adapted to engaging one of said horizontal stabilizing members and a hooked end to engage one of said cross members.

2. The system of claim 1 wherein said housing has a thickness ranging from 0.100 to 0.150 inches.

3. The system of claim 1 wherein said housing is comprised of plastic.

4. The system of claim 1 wherein said housing is comprised of polypropylene plastic.

5. The system of claim 1 where said housing is semi-rectangular.

6. The system of claim 1 wherein said contoured sides are tapered.

7. A system for continuous stack drying comprised of:

a plurality of cross members;

a plurality of horizontal stabilizing members;

at least four cross member stabilizing stackable blocks, each of said cross member stabilizing stackable blocks comprised of:

a housing having a flattened upper surface, an inner surface, a base opening, a first contoured side, a second contoured side and two flattened sides, each of said contoured sides having a flange;

wherein each of said flattened sides further include a u-shaped recessed portion disposed on an upper half of said flattened sides, each of said u-shaped recessed portions having a cross member aperture adapted to receive one of said cross members, said apertures being in alignment with each other;

wherein one of said u-shaped recessed portions further includes a stop lip;

a plurality of stacking ribs on the inner surface of each of said plurality of stabilizing stackable blocks adapted to rest on the outer surface of another of said cross member stabilizing stackable blocks;

a plurality of friction ribs on the inner surface of each of said plurality of stabilizing stackable block components wherein said friction ribs are adapted to physically contact one of said cross members;

a plurality of strengthening inner structural ribs on the inner surface of each of said plurality of stabilizing stackable block components;

wherein said first and second contoured sides each contain a horizontal stabilizing member aperture adapted to receive one of said horizontal stabilizing members;

a plurality of stabilizing struts, each of said stabilizing struts being removably attachable to one of said cross members and one of said horizontal stabilizing members, wherein each of said stabilizing struts has a forked interlocking end adapted to engage one of said horizontal stabilizing members and a hooked end to engage one of said cross members.

8. The system of claim 7 wherein said at least four cross member stabilizing stackable blocks, said plurality of cross members, and said plurality of horizontal stabilizing members may be stored in a duffel bag.

* * * * *